US005672017A

United States Patent [19]

Taniguchi

[11] Patent Number: 5,672,017

[45] Date of Patent: Sep. 30, 1997

[54] THERMAL PRINTER

[75] Inventor: Jun Taniguchi, Iwate-ken, Japan

[73] Assignee: Alps Electric Co., Ltd., Tokyo, Japan

[21] Appl. No.: 649,393

[22] Filed: May 17, 1996

[30] Foreign Application Priority Data

Jun. 16, 1995 [JP] Japan ..... 7-149869

[51] Int. Cl.[6] ..... B41J 2/315

[52] U.S. Cl. ..... 400/120.16; 400/120.01; 347/197

[58] Field of Search ..... 400/120.01, 120.16, 400/120.17, 55, 56, 57, 59; 347/197, 198, 220

[56] References Cited

U.S. PATENT DOCUMENTS 3,881,587 5/1975 Okabe ..... 197/1 R 4,952,084 8/1990 Maruyama ..... 400/120

5,071,266 12/1991 Harada et al. ..... 400/120

OTHER PUBLICATIONS

IBM Technical Disclosure Bulletin, vol. 20 No. J.D. Hall and G.H. Pennell Nov. 1977.

*Primary Examiner*—Edgar S. Burr
*Assistant Examiner*—Dave A. Ghatt
*Attorney, Agent, or Firm*—Guy W. Shoup; Patrick T. Bever

[57] ABSTRACT

A thermal printer which is designed to reduce costs by reducing the number of parts, and which can easily drive a carriage using an inexpensive low-power drive motor by reducing a load acting on the part of the carriage which carries a thermal head. The carriage is provided so as to travel reciprocatively along a platen. A thermal head is directly attached to the opposite side of the carriage to the platen without any intervening member. A biasing member is disposed for urging the carriage toward the platen.

2 Claims, 7 Drawing Sheets

THERMAL PRINTER

BACKGROUND OF THE INVENTION

1. Field of the Invention

The present invention relates to a thermal printer which records information on a recording medium, such as thermal sensitive paper, with a thermal head and, more particularly to, a thermal printer suitable for use with a recording type electronic desk-top calculator or an electronic cash register.

2. Description of the Prior Art

Recently, electronic desk-top calculators and electronic cash registers (ECR) are equipped with a small thermal printer which directly records information on a printing medium with a thermal head. A more compact and high-performance thermal printer of that type has been desired without an increase in price.

A conventional thermal printer 1 is constructed as shown in FIGS. 13 and 14. As can be seen from the drawings, a platen attachment section 8 is formed on a back frame 5, that is, a back frame of the thermal printer 1, so that a platen 7 can be attached to the platen attachment section 8. A support shaft 15 is supported by side frames 6L and 6R in parallel with the platen 7 in the vicinity of the front bottom of the platen attachment section 8. A carriage 14 is fitted around this support shaft 15 in such a way as to reciprocally travel along the platen 7. A worm fitting section 16 is formed into a recess at the lower part of the carriage 14 for receiving a worm 17 which drives the carriage 14. The carriage 14 is also provided with two projections at both lower corners of the carriage 14 on the platen 7 side. The projections constitute respective supporting sections 40, where through-holes 41 are formed. The support shaft 15 passes through the through-holes 41, so that the carriage 14 is supported so as to be able to travel as the worm 17 moves. Further, an opening (not shown) is formed in the surface of the carriage 14 facing the platen 7, and a coil spring 42 which acts as a biasing member is fitted into that opening for pressing the thermal head 10 against the platen 7.

A flat thermal head mounting unit 44 is attached between the supporting sections 40 of the carriage 14 so as to face the plate 7 and to rotate around the support shaft 15. The thermal head 10 is attached to the thermal head mounting unit 44 at the position opposing to the platen 7. An opening 43 is formed in the surface of the thermal head mounting unit 44 facing the carriage 14 for receiving the coil spring 42. The spring coil 42 is fitted between the opening 43 formed in the thermal head mounting unit 44 and the opening (not shown) formed in the carriage 14, so that the thermal head mounting unit 44 is rotated around the support shaft 15 by means of a biasing force of the coil spring 42. As a result of the rotation of the thermal head mounting unit 44, the thermal head 10 attached to the thermal head mounting unit 44 is pressed against the platen 7.

A carriage drive shaft 18 is rotatively supported by the side frames 6L and 6R in parallel with the platen 7 for transmitting torque from the drive motor 28 which is a drive source of the carriage 14. The worm 17 is connected to the carriage drive axis 18 by means of a spline. A rack plate 20 having rack cogs **20*a* formed thereon is provided on the base frame 2 in parallel with the carriage drive shaft 18, so that the rack cogs 20*a* mesh with the worm 17**.

Projecting cams **13*a* and 13*b* are formed on both ends of the platen attachment section 8, that is, they are positioned outside the area in which the thermal head 10 can carry out a printing operation. The cam sections 13*a* and 13*b* include end edges 11*a* and 11*b* which project from the platen attachment section 8 toward the carriage 14 in parallel with the direction of movement of the carriage 14. The projecting cams 13*a* and 13*b* further include tapered portions 12*a* and 12*b* which are tapered in parallel with the direction of the movement of the carriage 14 so as to extend between the respective end edges 11*a* and 11*b* and the vicinity of the ends of the platen 7. With this structure, if the thermal head 10 carries out a printing operation beyond the printable range, the thermal head mounting unit 44 travels along the tapered portions 12*a* and 12*b* of the cams 13*a* and 13*b* against the biasing force of the coil spring 42 as the carriage 14 moves, whereby the thermal head 10 is moved away from the platen 7**.

The operation of the conventional thermal printer having the above mentioned structure will next be described.

Upon receipt of torque imparted from the drive motor for driving the carriage 14 via a torque transmission means 50, the carriage drive shaft 18 rotates, which in turn starts the rotation of the worm 17. Since the worm 7 meshes with the rack cogs **20*a* formed on the rack plate 20, it travels reciprocatively along the rack plate 20. Together with this movement, the carriage 14 starts to travel reciprocatively along the platen 7 while being supported by the support shaft 15. The thermal head mounting unit 44, rotatively attached to the support shaft 15 between the supporting sections 40 of the carriage 14, is constantly urged toward the platen 7 by the biasing force of the coil spring 42, so that the thermal head 10 attached to the thermal head mounting unit 44 is pressed against the platen 7 with a recording medium, e.g., heat sensitive paper, between them. The thermal head 10 prints one line on the heat sensitive paper within the printable range by heating a heating section (not shown) according to a predetermined print command. Subsequently, if the thermal head 10 moves beyond the printable range, the thermal head mounting unit 44 travels along the tapered portions 12*a* and 12*b* of the cams 13*a* and 13*b* while being rotated toward the carriage 14 against the biasing force of the coil spring 42 as the carriage 14 moves. As a result, the thermal head 10 is moved away from the platen 7. When the thermal head mounting unit 44 reaches the end edges 11*a* and 11*b* of the cams 13*a* and 13*b*, the carriage 14 stops moving, and the heat sensitive paper is fed by a feed roller (not shown). When the heat sensitive paper is fed, the drive motor starts to reversely rotate, so that the torque is transmitted to the carriage drive shaft 18 via the torque transmission means. As a result, the carriage drive shaft 18 also starts to rotate reversely, thereby causing the carriage 14 to move in the opposite direction. Then, the thermal head 10** repeats printing operations in the manner as previously mentioned until a desired printing operation is completed.

In the foregoing conventional thermal printer 1, the carriage 14 merely moves the thermal head 10 in parallel with the platen 7. In order to move the thermal head 10 toward the platen 7 and to press it against the front face of the platen 7, it is necessary to separately provide the thermal head mounting unit 44 that can pivot toward the platen 7 while having the thermal head 10 attached thereto. Further, in order to move the thermal head mounting unit 44 and the carriage 14 in an integrated fashion, the thermal head mounting unit 44 must be rotatively fitted around the support shaft 15 to which the carriage 14 is also fitted. The thermal head mounting unit 44 must be provided with two projecting supporting sections 40, each having the through-hole 41 respectively formed therein, so that the support shaft 15 passes therethrough. Furthermore, it is necessary to form the fitting opening 43 and the counterpart opening in the thermal head mounting unit 44 and the carriage 14, respectively, for receiving the coil spring 42. With all the requirements described above, the conventional thermal printer 1 has such a problem that additional costs are incurred by manufacturing the thermal head mounting unit 44 and the supporting sections 40 of the carriage 14 for receiving the thermal head mounting unit 44.

When the carriage 14 travels along the tapered portions **12*a* and 12*b* of the cams 13*a* and 13*b*, the thermal head mounting unit 44 also moves while remaining in slidable contact with the tapered portions 12***a* and 12*b* of the cams 13*a* and 13*b*, as well as pivoting from the platen 17 toward the carriage 14 against the biasing force of the coil spring 42. As a result, the biasing force of the coil spring 42 is accordingly increased.

In order to move the thermal head mounting unit 44 against the load imposed by the cams 13*a* and 13*b*, the carriage 14 must be driven by a drive motor with larger torque, which makes it impossible to use an inexpensive low-powered motor.

SUMMARY OF THE INVENTION

The present invention is conceived to reduce the number of parts and associated costs by integrating together a thermal head mounting unit and a carriage so that the carriage itself can be pressed against a platen by a biasing force of a biasing member. Another object of the present invention is to provide a thermal printer which can easily drive the carriage using an inexpensive low-power drive motor by reducing the load acting on the thermal head carrying portion of the carriage by means of a structure formed so as to reduce the biasing force of the biasing member which increases as the carriage carrying the thermal head travels along the cam.

Still another object of the present invention is to provide a thermal printer comprising a carriage provided so as to be movable along the platen, a thermal head attached to the carriage so as to be opposite to the platen, and a biasing member for urging the carriage toward the platen to press the thermal head against the platen.

A further object of the present invention is to provide a thermal printer comprising a leaf spring having one end fixed to the opposite side of the carriage to the side where the thermal head is attached and the other end remaining in slidable contact with a leaf spring abutment section formed on the base frame of the main body parallel to the direction of the movement of the carriage. The latter end moves reciprocatively while remaining in slidable contact with the leaf spring abutment section as the carriage travels reciprocatively.

Still further object of the present invention is to provide a thermal printer comprising two cams formed in the vicinity of both ends of the platen outside a printable range of the thermal head so as to move the thermal head away from the platen against the biasing force of the leaf spring when the thermal head travels beyond the printable range as the carriage moves, and tapered sections formed in the leaf spring abutment section which are tapered in such a direction as to progressively reduce the biasing force of the leaf spring as the carriage travels along the cams towards their respective ends.

In the present invention, the thermal head is directly attached to the carriage, and the thermal head is pressed against the platen by urging the carriage toward the platen using the biasing member. As a result, it is possible for the thermal head to carry out a printing operation with such a simple construction.

Further, the biasing member is made up of the leaf spring, and one end of this leaf spring is fixed to the carriage while the other end thereof is in slidable contact with the leaf spring abutment section formed on the base frame of the main body. As a result, it is possible to urge the carriage toward the platen.

According to the present invention, when the thermal head travels beyond its printable range as the carriage moves, the carriage travels along tapered portions of the cams on both ends of the platen against the biasing force of the leaf spring, thereby causing the thermal head to move away from the platen. In this event, the biasing force of the leaf spring is normally increased, and hence large torque becomes necessary to move the carriage because the load acting on the carriage becomes greater due to the increasing biasing force. However, in the present invention, the leaf spring travels along the tapered sections formed in the leaf spring abutment section which are tapered so as to reduce the biasing force of the leaf spring as the leaf spring approaches both ends of the leaf spring abutment section. For this reason, the biasing force of the leaf spring does not increase, and hence there is no need to increase the torque required to move the carriage. As a result of a spring tape cassette being set in a cassette housing, the torque transmission mechanism is connected to a platen drive gear for rotating a platen roller, and it is possible to deliver the torque from the motor to a platen roller.

DETAILED DESCRIPTION OF THE PREFERRED EMBODIMENT

A preferred embodiment of the present invention will now be described with reference to the drawings.

Figure 1:
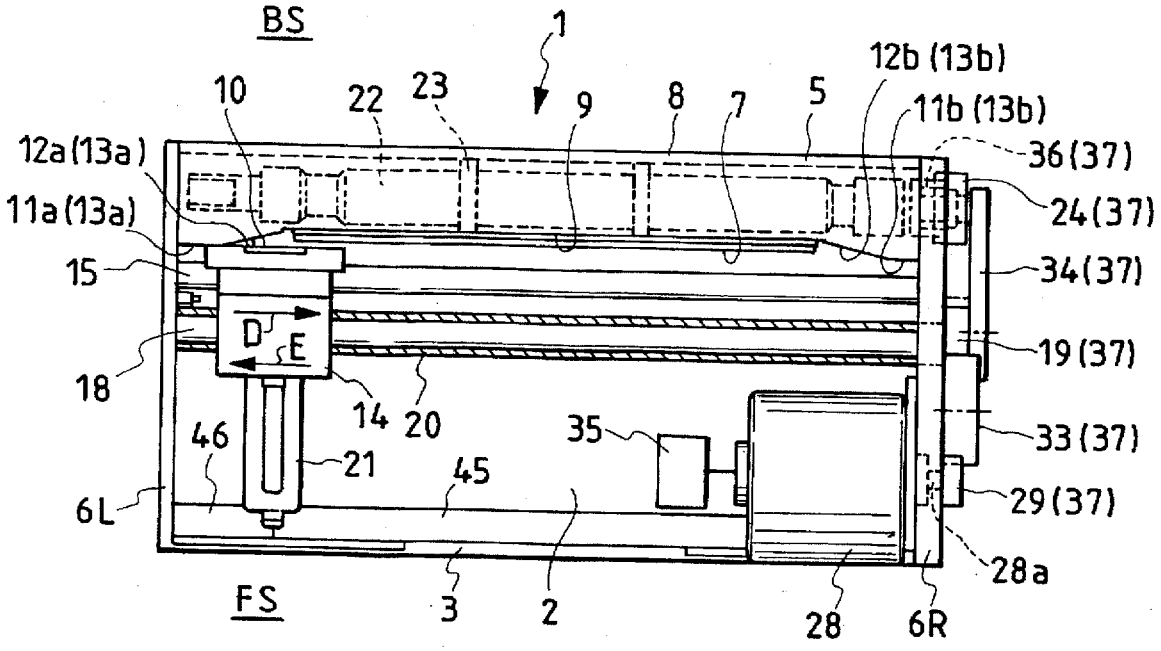
FIG. 1 is a plan view showing the principal elements of a thermal printer of the present invention, in which a carriage is positioned at the leftmost home position in its movable range.
Figure 2:
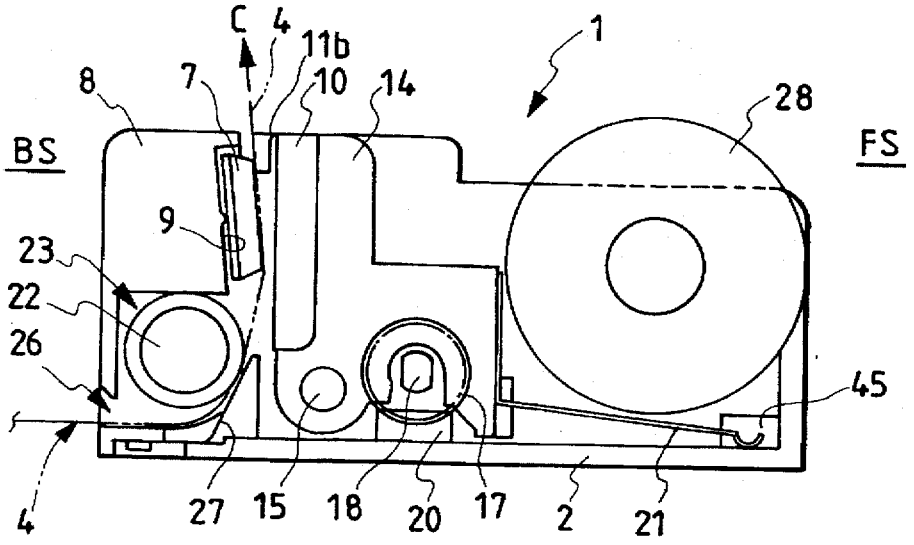
FIG. 2 is a left side view of the thermal printer shown in FIG. 1.
Figure 3:
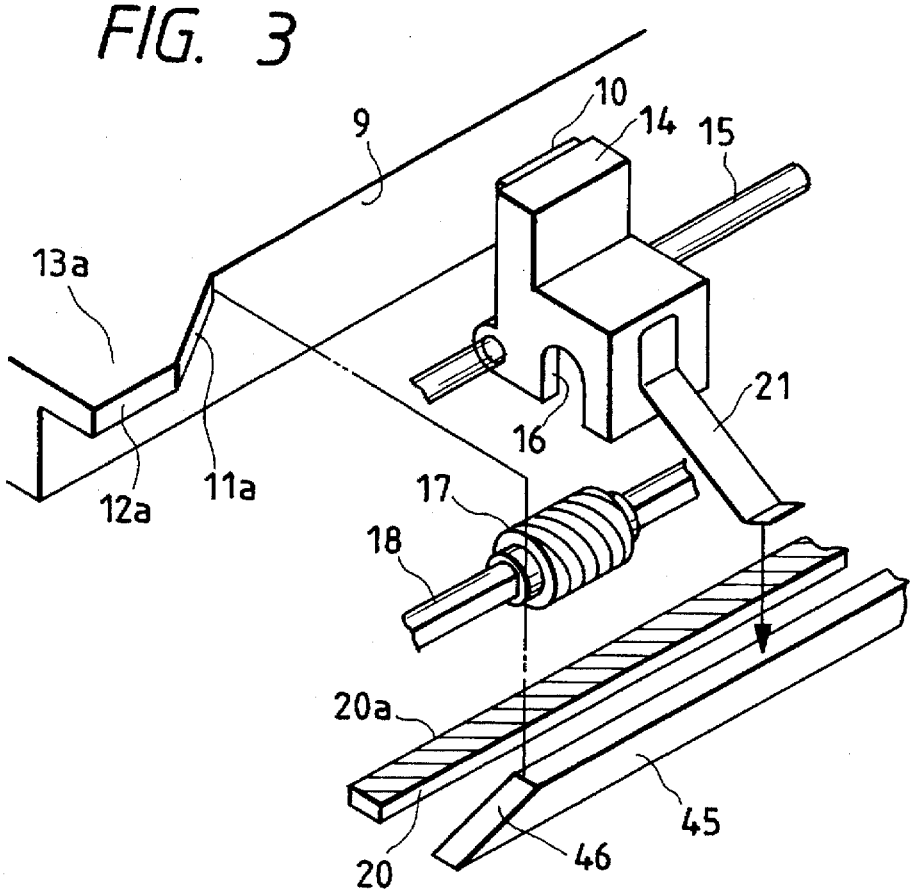
FIG. 3 is an exploded perspective view showing a carriage and its surrounding of the thermal printer according to the present invention.
Figure 4:
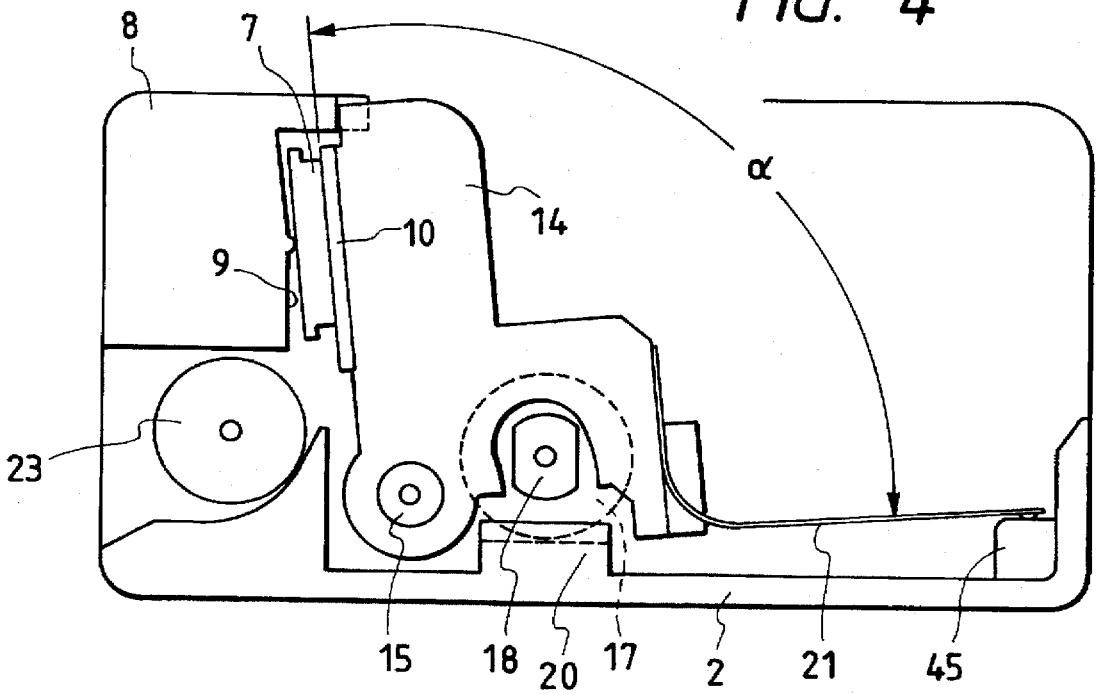
FIG. 4 is a side view showing conditions of the carriage and a leaf spring when a thermal head is pressed against a platen.
Figure 5:
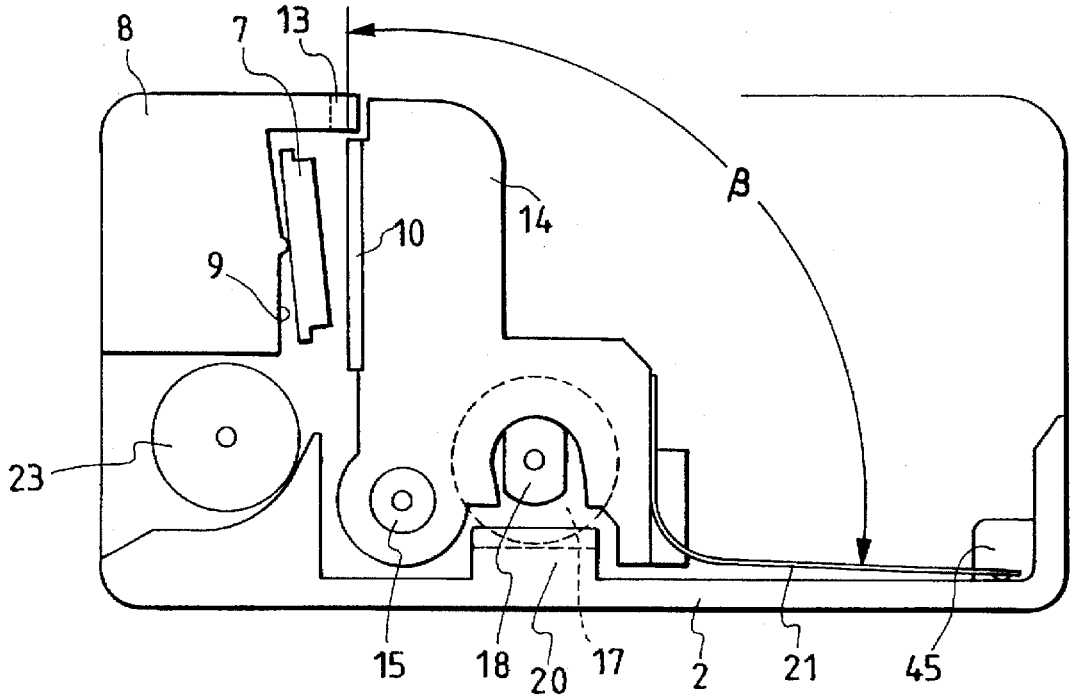
FIG. 5 is a side view showing conditions of the carriage and the leaf spring when the carriage is in contact with the end of the cam formed at the end of the platen.
Figure 6:
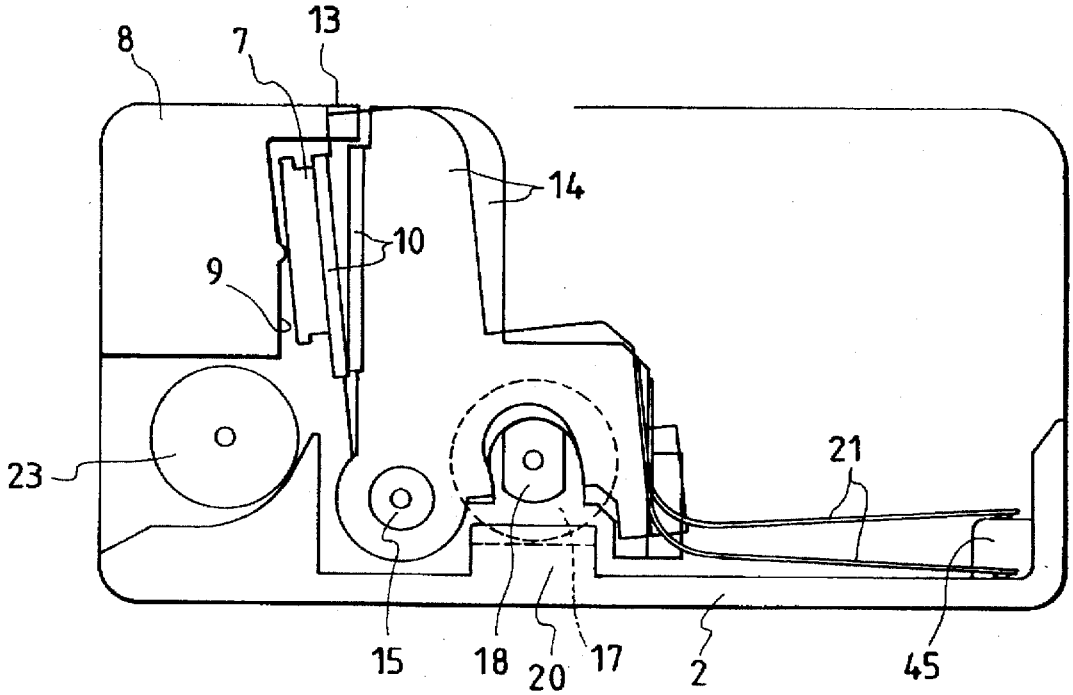
FIG. 6 is a side view showing conditions of the carriage and the plane spring by superimposing FIGS. 4 and 5 on each other.
Figure 7:
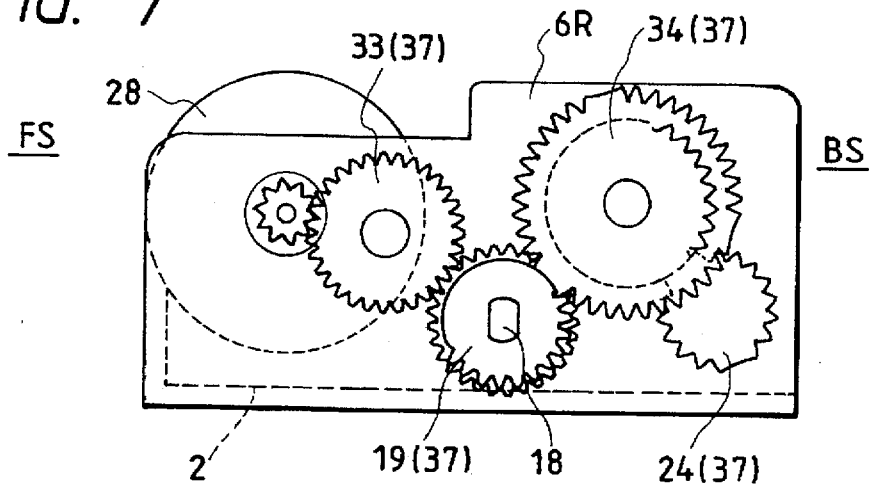
FIG. 7 is a right side view of the thermal printer shown in FIG. 1.
Figure 8:
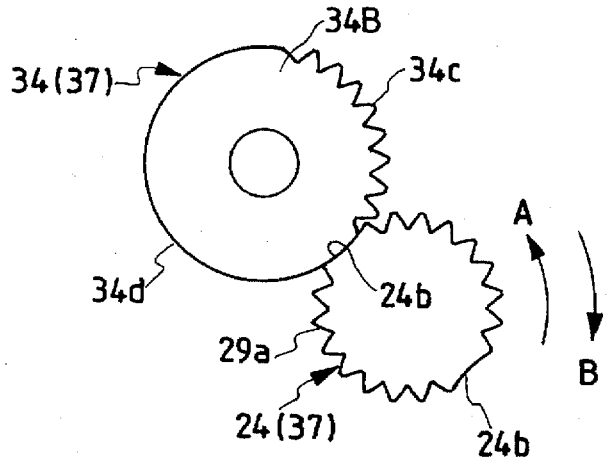
FIG. 8 is an enlarged partial view for explaining a roller drive gear and its surrounding shown in FIG. 1.
Figure 9:
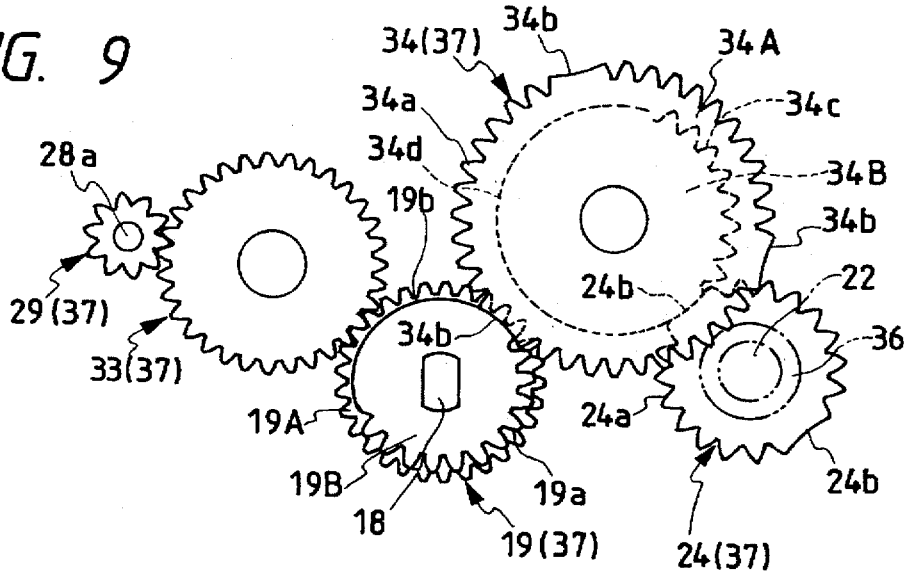
FIG. 9 is an explanatory view of the construction of a torque transmission means shown in FIG. 1.

FIG. 1 is a plan view showing the principal elements of a thermal printer according to a first embodiment of the present invention. FIG. 2 is a left side view showing the inside construction of the principal elements with some omitted. FIG. 3 is an exploded perspective view showing the construction of a carriage 14 and its surrounding. FIGS. 4 to 6 are explanatory views of the construction of the carriage 14 and its surrounding when a thermal head 10 is pressed against a platen 7. FIG. 7 is a right side view showing the principal elements. FIG. 8 is an enlarged partial view showing the construction of a roller drive gear 24 and its surrounding. FIG. 9 is an explanatory view of the construction of torque transmission means 37.

The same elements as those used in the description of the prior art are assigned the same reference numerals.

As shown in FIG. 1, the thermal printer according to a first embodiment of the present invention has an external frame made up of a plurality of frames as a top face of a rectangular parallelepiped is opened. The frames include a base frame 2 which is disposed as the bottom of the frames. Among the frames, a face frame 3 comprising a rectangular plane is provided at a front side FS of the thermal printer 1 as it is shown in a lower part of FIG. 1. A record plane of heat sensitive paper 4 which serves as a recording medium can be visually recognized from the front side FS of the face frame 3.

As shown in an upper part of FIG. 1, a back frame 5 having a substantially rectangular cross section is disposed on a back side BS from which the heat sensitive paper can be fed. This back frame 5 also serves as a platen attachment section 8 for receiving the platen 7.

As shown in FIG. 1, a pair of side frames 6L and 6R are positioned on the both longitudinal ends of the base frame opposite to each other for supporting the front and back frames 3 and 5.

A platen attachment recess 9 is formed at the longitudinal center of the front side FS of the platen attachment section 8, and a substantially planar platen 7 is attached to the recess. A pair of cams 13*a* and 13*b* are formed on respective longitudinal ends of the platen attachment section 8 for bringing the thermal head 10 into or out of contact with the platen 7. These cams 13*a* and 13*b* project from the platen 7 side toward the carriage 14. End edges 11*a* and 11*b* are formed on the respective cams 13*a* and 13*b* parallel to the direction in which the carriage 14 moves. Tapered portions 12*a* and 12*b* are formed so as to extend from the respective end edges 11*a* and 11*b* to the platen mounting recess 9. The tapered portions 12*a* and 12*b* are tapered in the direction in which the carriage 14 moves.

As shown in FIGS. 1 and 2, a support shaft 15 is provided at a lower portion of the front side FS of the platen 7 in such a way as to extend parallel to the platen 7 for supporting the carriage 14 so as to oppose the platen 7 at a desired position. Both ends of the support shaft 15 are held by the side frames 6L and 6R, respectively. The carriage 14 is pivotally attached to the support shaft 15 so as to rotate around the support shaft 15, as well as to longitudinally travel reciprocatively along the support shaft 15.

The thermal head 10 is attached to the back side BS of the carriage 14 shown in an upper part of FIG. 1 so as to be opposite to the platen 7. The thermal head 10 includes a plurality of heating elements (not shown) which are regularly arranged on the thermal head and are selectively heated on the basis of desired print information. The thermal head 10 is designed to print the information on the heat sensitive paper 4 held by the platen 7 in a so-called head down condition, that is, while it is pressed against the platen 7.

As shown in FIG. 3, an arched worm fitting section 16 is formed in the bottom of the carriage 14, and a worm 17 is fitted into this worm fitting section 16. The worm 17 is connected to a carriage drive shaft 18 by means of a spline. The drive shaft 18 has a substantially rectangular cross section and extends parallel to the support shaft 15. The carriage drive shaft 18 is rotatively supported by the side frames 6L and 6R. A carriage drive gear 19 for rotating the carriage drive shaft 18 is disposed at the right end of the carriage drive shaft 18 shown in FIG. 1 so as to be positioned outside (on the right side of) the side frame 6R.

As shown in FIGS. 1 to 3, the base frame 2 positioned below the carriage drive shaft 18 is provided with a rack plate 20 which extends parallel to the carriage drive shaft 18. The rack plate 20 has rack cogs 20*a* formed thereon for engaging with the worm 17.

Rotation of the carriage drive shaft 18 causes rotation of the worm 17 connected to the carriage drive shaft 18 by the spline. Then, the worm 17 can travel reciprocatively in such a longitudinal direction as designated by the arrows D and E shown in FIG. 1 by means of the rack cogs 20*a* formed on the rack plate 20 which mesh with the worm 17. Associated with the movement of the worm 17, the carriage 14 is also designed to travel along the platen 7 and the platen attachment section 8 in the directions designated by the arrows D and E shown in FIG. 1 within a predetermined movable range.

As shown in FIG. 3, a leaf spring 21 is provided on the front side FS of the carriage 14 so as to constantly urge the carriage 14 toward the platen 7 and the platen attachment section 8 so that the thermal head 10 can be pressed against the platen 7. One end of the leaf spring 21 is fixed to the front side FS of the carriage 14, that is, the opposite side of the carriage 14 to where the thermal head 10 is attached. The other end (a free end) of the leaf spring 21 comes into contact with a leaf spring abutment section 45. This leaf spring abutment section 45 has a rectangular cross section and is formed on the front side FS of the base frame 2 parallel to the carriage drive shaft 18. The free end of the leaf spring 21 slides over the base frame 2 as the carriage 14 moves while it is bent like an arc.

The leaf spring abutment section 45 includes tapered sections 46 which are opposite to the cams 13*a* and 13*b*. While the carriage 14 is moving along the cams 13*a* and 13*b*, the free end of the leaf spring comes into contact with the tapered sections. The tapered sections 46 are tapered to progressively reduce the increasing biasing force of the leaf spring as the carriage 14 approaches the respective ends of the cams. The cone angle of the tapered section 46 is substantially the same as that of the tapered portions 12*a* and 12*b* of the cams 13*a* and 13*b*.

FIG. 4 is a side view showing the carriage 14 and the leaf spring when the thermal head 10 is pressed against the platen 7. FIG. 5 is a side view showing the carriage 14 and the leaf spring when the carriage 14 is pressed against the end edges 11*a* and 11*b* of the cams 13*a* and 13*b*. FIG. 6 is an explanatory view of the carriage 14 and the leaf spring obtained by superimposing these elements shown in FIGS. 4 and 5 on each other. In these drawings, the angle between the free end of the leaf spring that is in contact with the leaf spring abutment section 45 and the front face of the thermal head 10 is designated as $\alpha$ in FIG. 4 and $\beta$ in FIG. 5. In this embodiment, the height of the plate spring abutment section 45 is determined such that $\alpha$ becomes smaller than $\beta$, or $\alpha<\beta$. With this arrangement, the biasing force of the leaf spring can be prevented from increasing when the carriage 14 travels along the tapered portions 12*a* and 12*b* of the cams 13*a* and 13*b*. As a result, an extra force necessary to move the thermal head 10 away from the platen 7 can be reduced.

As shown FIGS. 1 and 2, a roller drive shaft 22 is rotatively provided at a lower portion of the platen attachment section 8 on the back side BS of the thermal printer 1 in such a way as to extend parallel to the platen 7. A paper feed roller 23 is fitted around the roller drive shaft 22 for feeding the heat sensitive paper 4 to the position opposite to the thermal head 10. A roller drive gear 24 for transmitting torque to the roller drive shaft 22 is attached to the right end of the roller drive shaft 22 as shown in FIG. 1 in such a way as to situate outside of the side frame 6R by way of a one-way clutch 36. Specifically, the roller drive gear 24 acts as a clutch gear by virtue of the one-way clutch 36, and it transmits a rotational force (torque) to the roller drive shaft 22 only when it is rotated in one direction.

As described above, the carriage 14 is capable of traveling along the platen attachment section 8 as the worm 17 moves, and it presses the thermal head 10 attached to the carriage 14 against the platen 7 for printing. Further, when the heat sensitive paper sheet 4 is fed by the paper fed roller 23 after the thermal head 10 has finished printing one line, the carriage 14 travels along the respective tapered portions 12*a* and 12*b* of the cams 13*a* and 13*b* toward their end edges 11*a* and 11*b*, whereby the thermal head is brought into a position away from the platen 7.

Torque transmission means 37 of the first embodiment will now be described.

As shown in FIG. 1, a stepping motor 28 serving as a drive motor is disposed in the vicinity of the right end of the front side FS of the base frame 2 with its output shaft 28*a* directing towards the right. The output shaft 28*a* is positioned so as to pass through the side frame 6R, and a carriage output gear 29 is attached to the leading end of the output shaft 28*a* so as to situate outside (on the right side of) the side frame 6R. Further, a spur idle gear 33 for transmitting rotations of the carriage output gear 29 to the carriage driving gear 19, and a transmission gear 34 for transmitting rotations of the carriage driving gear 19 to the roller drive gear 24 are also provided outside the side frame 6R. The stepping motor 28 can be driven at a desired drive frequency by a controller 35.

The carriage driving gear 19 and the roller driving gear 24 will now be described in more detail, including the operational relationship between them and the idle gear 33 and the carriage transmission gear 34.

The carriage driving gear 19 is attached to the right end of the carriage drive shaft 18, as shown in FIG. 1. The carriage driving gear 19 consists of two gears, as is shown in FIG. 7, namely, a fully cogged gear 19A for constantly engaging with the idle gear 33, and a partially cogged gear 19B capable of engaging with the carriage transmission gear 34. The partially cogged gear 19B has a cogged part 19*a* formed around half of the circumferential edge thereof, and a cogless part 19*b* formed around the other half. The partially cogged gear 19B has a smaller diameter than that of the fully cogged gear 19A. The external edge of the cogless part 19*b* of the partially cogged gear 19B is positioned closer to the center of the fully cogged gear 19A than the root circle of the same.

The roller driving gear 24 is attached to the right end of the roller drive shaft 22 via the one-way clutch 36, as shown in FIG. 1.

When the roller driving gear 24 rotates in such a counterclockwise direction as designated by arrow A shown in FIG. 8, the counterclockwise rotation of the roller driving gear 24 is transmitted as a drive force (torque) to the roller drive shaft 22 via the one-way clutch 36, so that the heat sensitive paper 4 is fed (in a transmission direction). On the other hand, when the roller driving gear 24 rotates in such a clockwise direction as designated by arrow B, the clockwise rotation of the roller driving gear is interrupted by the one-way clutch 36, so that the rotation is not transmitted to the roller drive shaft 22 as a rotating force (torque), as a result of which the roller driving gear 24 only idles without feeding the heat sensitive paper 4 (in an idling direction).

The roller driving gear 24 has a cogged part 24*a* formed along the circumference thereof except for its substantially opposite portion to the roller driving gear, as it is shown in FIG. 8. The part of the circumference other than the cogged part 24*a* is formed into a recessed cogless part 24*b*, and this recessed cogless part prevents interference with a cogless part 34*b* of a second transmission gear 34B of the carriage transmission gear 34 which will be described later.

The carriage transmission gear 34 is made up of two gears, as is shown in FIG. 9; namely, a first spur transmission gear 34A capable of engaging with the partially cogged gear 19B of the carriage driving gear 19, and a second spur transmission gear 34B capable of engaging with the roller driving gear 24. The carriage transmission gear 34 is arranged so as to rotate once for every three rotations of the carriage driving gear 19.

The first transmission gear 34A has a cogged part 34*a* formed along its circumference, and a cogless part 34*b* is also formed for every one third of the circumference. The cogless part 34*b* is recessed so as not to interfere with the cogless part 19*b* of the partially cogged gear 19B of the carriage driving gear 19.

The second transmission gear 34B has a smaller diameter than that of the first transmission gear 34A. The second transmission gear 34B has a cogged part 34*c* formed along one third of its entire circumference, leaving the other two thirds as a cogless part 34*d*. The external edge of the second transmission gear 34B is positioned closer to the axis of the first transmission gear 34A than the root circle of the same.

The above mentioned gears, i.e., the carriage output gear 29, the idle gear 33, the carriage driving gear 19, the carriage transmission gear 34, the roller driving gear 24, and the one-way clutch 36, constitute the torque transmission means 37.

As shown in FIG. 2, a paper feed slot 26 through which the heat sensitive paper 4 is fed is opened in the lower portion of the plate attachment section 8 on the back side BS of the thermal printer 1. An urging spring 27 is provided at the end of the base frame 2 in the vicinity of the back side BS for urging the heat sensitive paper sheet 4 fed through the paper feed slot 26 toward the paper feed roller 23 with an appropriate bias force. In other words, when the paper feed roller 23 is rotated, the heat sensitive paper 4 is conveyed (fed) in the direction designated by arrow C shown in FIG. 2 (a paper feeding direction).

The operation of the first embodiment having the above mentioned construction will now be described, referring to FIGS. 1 to 12.

Figure 10:
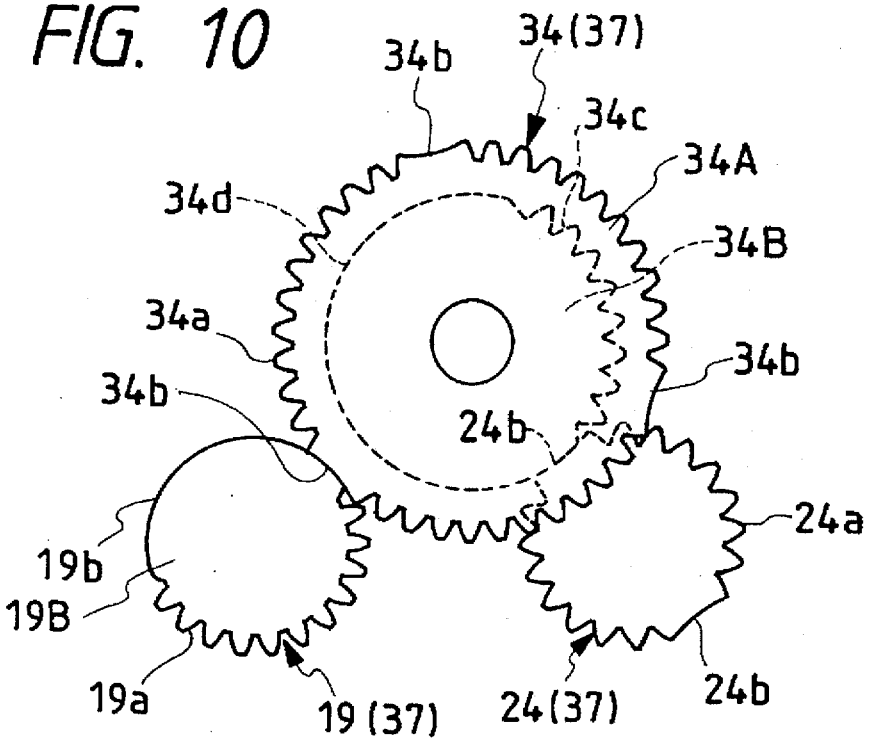
FIG. 10 is an enlarged partial view of the transmission gear and its surrounding shown in FIG. 1.
Figure 11:
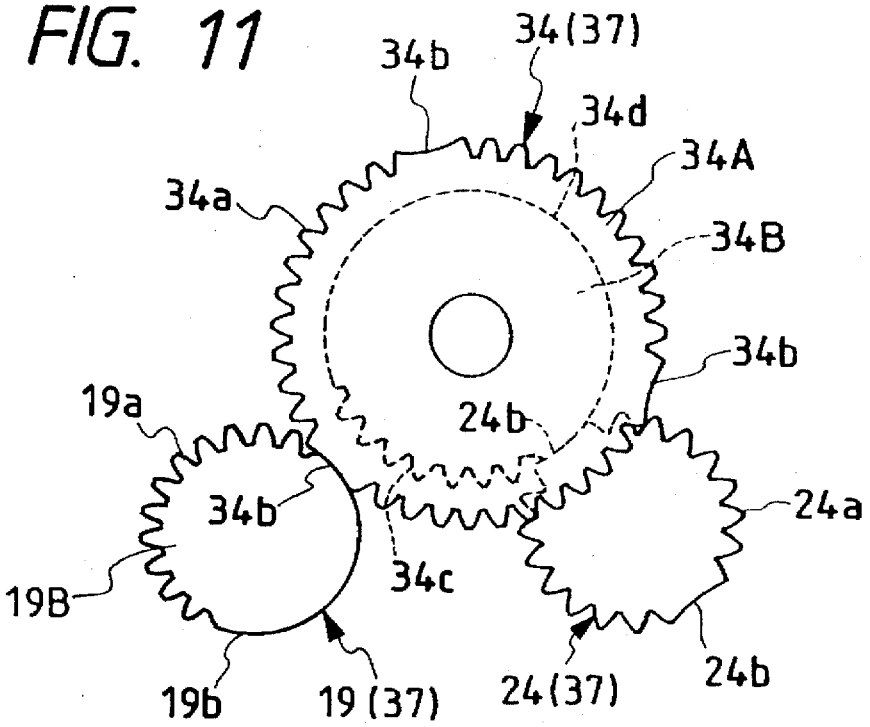
FIG. 11 is a plan view showing the principal elements of the thermal printer of the present invention when the carriage is positioned at the rightmost position in the movable range opposite to the position shown in FIG. 1.
Figure 12:
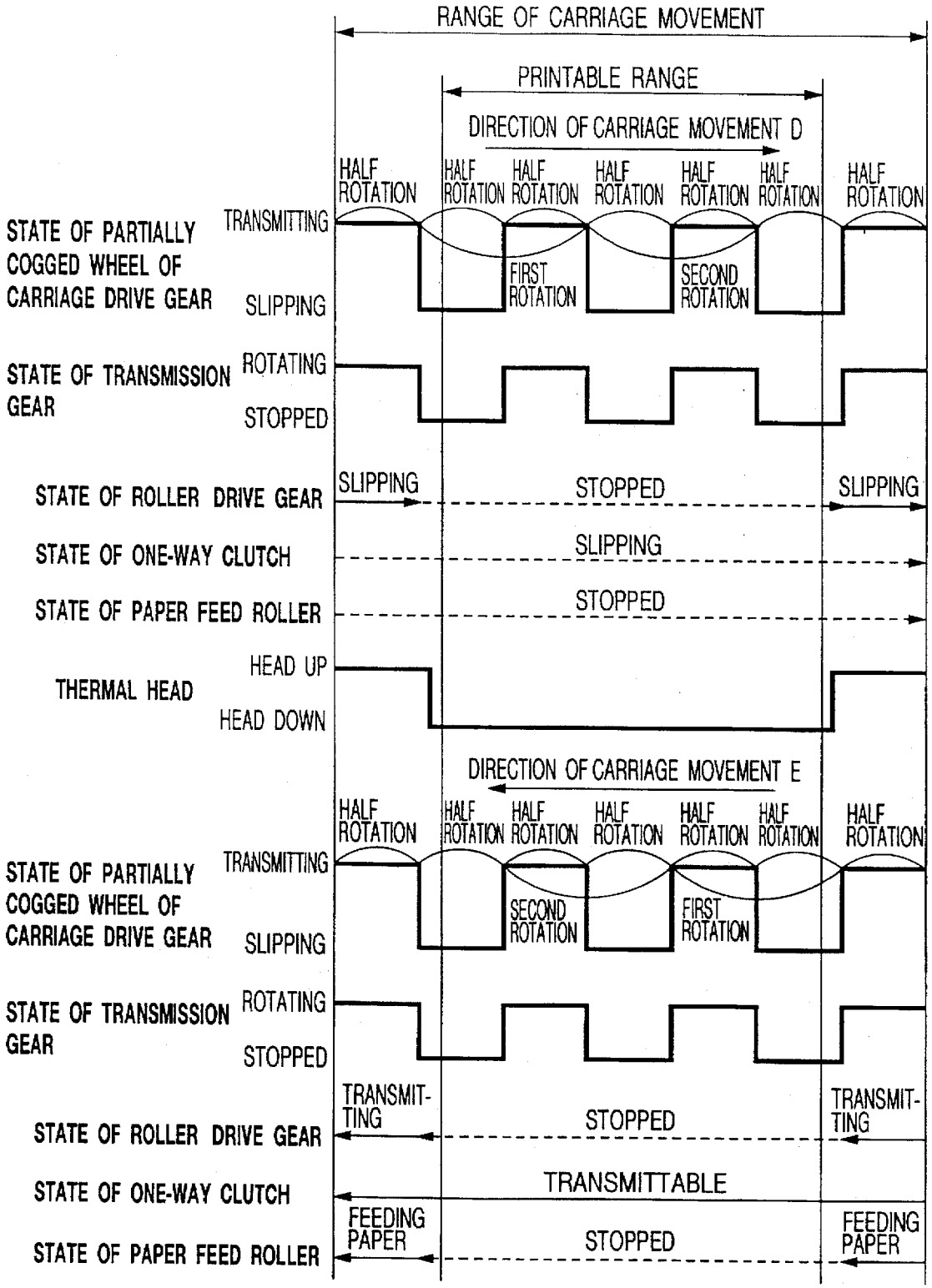
FIG. 12 is an explanatory view showing the operation of the principal elements of the thermal printer according to an embodiment of the present invention.
Figure 13:
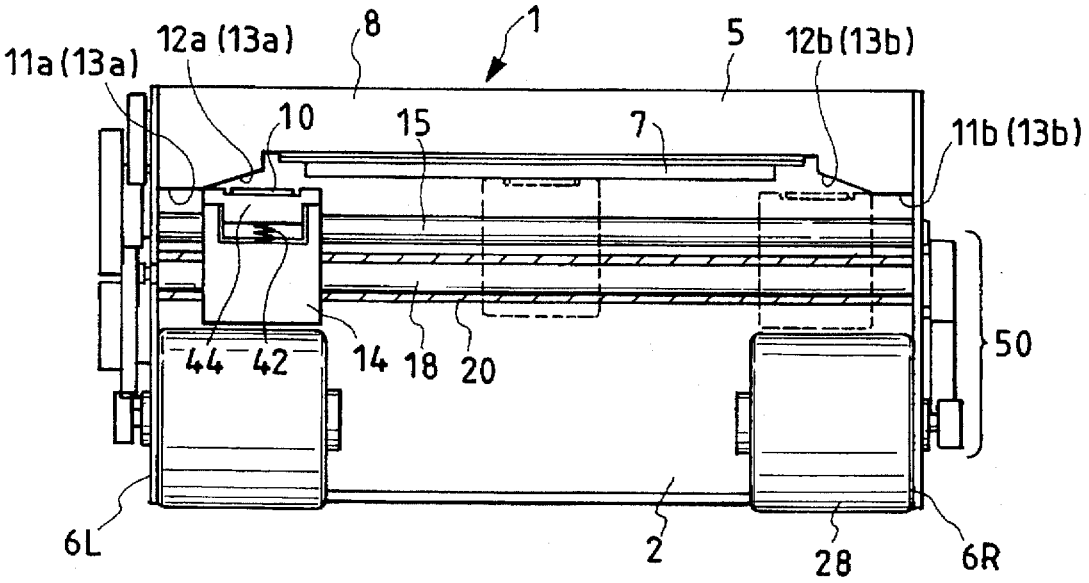
FIG. 13 PRIOR ART
FIG. 13 is a plan view of the principal elements of a conventional thermal printer.
Figure 14:
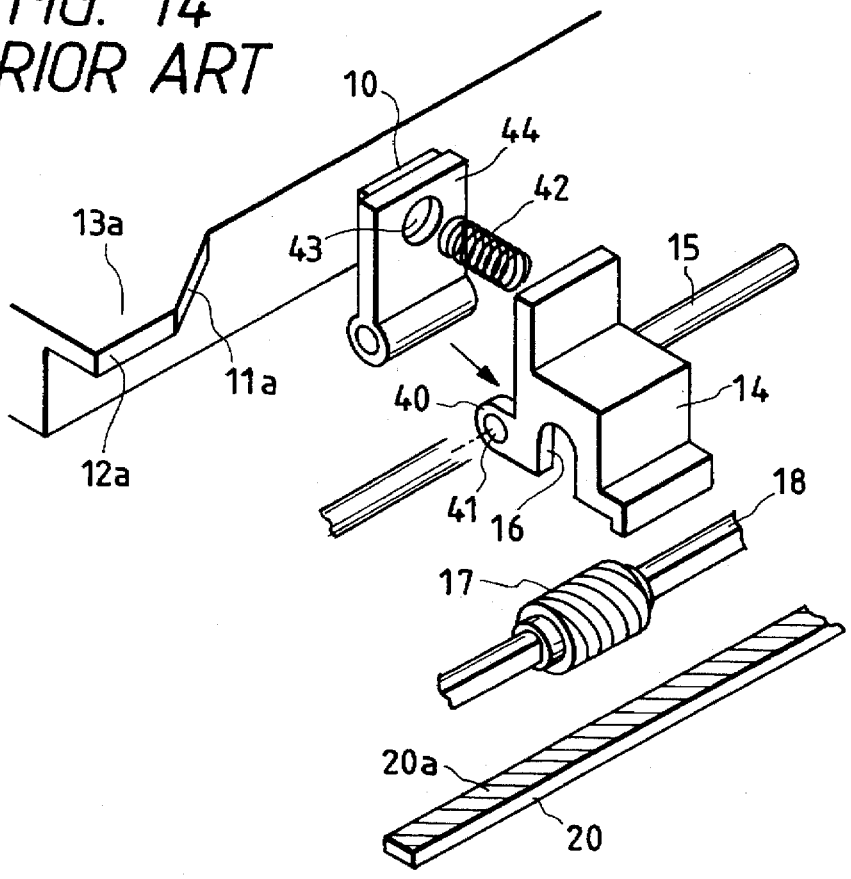
FIG. 14 PRIOR ART
FIG. 14 is an exploded perspective view showing a carriage and its surrounding of the conventional thermal printer.

FIGS. 1 and 2 and FIGS. 7 to 9 respectively show an initial condition where the carriage 14 is positioned at the home position on the left end of the movable range. FIG. 10 is an enlarged partial view showing the carriage transmission gear 34 and its surrounding when it is in the initial condition. FIG. 11 is an enlarged partial view showing the carriage transmission gear 34 and its surrounding when it is positioned at the right end of the movable range which is opposite to the home position. FIG. 12 is an explanatory view for explaining the operation of the principal elements of the thermal printer 1.

In the initial condition where the carriage 14 of the thermal printer 1 according to the first embodiment stays at the home position, the left end of the back side BS of the carriage 14 is urged to abut on the cam projection 11*a* of the cam 13*a* formed at the left end of the platen attachment section 8, by means of the biasing force of the leaf spring 21. The thermal head 10 is brought in a head-up state, i.e., it is lifted away from the platen, while being positioned opposite to the tapered portion 12*a* of the cam 13*a* at the left end of the platen attachment section 8. At this time, the leaf spring abuts on the lowest portion of the tapered section 46 of the cam plate abutment section, as shown in FIG. 5. The biasing force of the leaf spring is in a reduced state, and hence the carriage 14 undergoes only a small load.

When the torque transmission means 37 is in the initial condition, as is shown in FIG. 9, the idle gear 33 meshes with the carriage output gear 29 attached to one end of the stepping motor 28. The idle gear 33 also meshes with the fully cogged gear 19A of the carriage driving gear 19. The partially cogged gear 19B of the carriage driving gear 19 is positioned such that the cogged part 19*a* thereof is directed to the lower right, as shown in FIG. 10. The cogless part 34*b* of the first transmission gear 34A of the transmission gear 34 is positioned adjoining the cogged part 19*a* of the partially cogged gear 19B so as to be opposite to its cogless part 19*b*. As a result, the carriage driving gear 19 and the carriage transmisson gear 34 are not engaged with each other. Further, the second transmission gear 34B of the carriage transmission gear 34 is positioned such that the cogged part 34*c* is directed to the lower right, as shown in FIG. 8. The cogless part 24*b* of the roller driving gear 24 is positioned adjoining to the cogged part 34*c* of the second transmission gear 34B so as to be opposite to its cogless part 34*d*. As a result, the carriage transmission gear 34 and the roller driving gear 24 are not engaged with each other.

The heat sensitive paper 4 is manually fed via the paper feed slot 26 and pressed against the paper feed roller 23 by means of the biasing force of the urging spring 27.

When the stepping motor 28 in the initial condition is driven according to a control command (not shown), and the output shaft 28*a* of the stepping motor 28 is caused to rotate counterclockwise, as is shown in FIG. 9, the carriage output gear 29 attached to the end of the output shaft 28*a* starts to rotate counterclockwise. As a result, the rotating force (torque) of the stepping motor 28 is transmitted to the carriage driving gear 19 via the idle gear 33, whereby the carriage driving gear 19 starts to rotate counterclockwise as shown in FIG. 8. In conjunction with this counterclockwise rotation of the carriage driving gear 19, the carriage drive shaft 18 starts to rotate counterclockwise, thereby causing the worm 17 connected to the carriage drive shaft 18 by the spline to rotate counterclockwise. Eventually, the worm 17 starts travel to the right over the rack plate 20 as designated by arrow D shown in FIG. 1. The rightward movement of the worm 17 causes the carriage 14 to move to the right, as it is designated by arrow D shown in FIG. 1.

When the stepping motor 28 is rotated counterclockwise, the carriage driving gear 19 rotates counterclockwise first half rotation. As a result, the cogged part 19*a* of the partially cogged gear 19B of the carriage driving gear 19 comes to engage with the cogged part 34*a* of the first transmission gear 34A of the carriage transmission gear 34, as shown in FIG. 9. This engagement causes the carriage transmission gear 34 to rotate clockwise one-third turn, as shown in FIG. 8. At this time, the cogged part 34*c* of the second transmission gear 34B of the carriage transmission gear 34 engages with the cogged part 24*a* of the roller driving gear 24, thereby causing the roller driving gear 24 to rotate counterclockwise one-half turn, as shown in FIG. 9. Since the roller driving gear 24 is connected to the roller drive shaft 22 via the one-way clutch 36, as described above, the counterclockwise rotation of the roller driving gear 24 designated by the arrow A shown in FIG. 8 is not transmitted to the roller drive shaft 22, thereby causing the roller driving gear 24 to simply idle.

As a result of the first half counterclockwise rotation of the carriage driving gear 19 due to the counterclockwise rotation of the stepping motor 18, the thermal head 10, which moves with the carriage 14, moves along the tapered portion 12*a* of the cam 13*a* formed at the left end of the platen attachment section shown in FIG. 1 toward the platen attachment recess 9 before it enters into the printable range. The thermal head 10 is then brought into a head down position by means of the biasing force of the leaf spring 21.

As a result of the next two and a half counterclockwise rotations of the carriage driving gear 19 caused by the counterclockwise rotation of the stepping motor 28, the carriage 14 further travels to the right while the thermal head 10 is retained in the head-down state, that is, it is pressed against the platen 7. When the thermal head 19 is located within the printable range during the movement of the carriage 14, the plurality of heating elements (not shown) regularly arranged on the thermal head 10 are selectively heated according to predetermined printing information, whereby the information is printed on the heat sensitive paper 4.

At this time, one end of the leaf spring abuts on the uppermost face of the leaf spring abutment section 45 while the other end thereof urges the carriage 14 toward the platen 7. Accordingly, the thermal head 10 mounted on the carriage 14 is pressed against the platen with a desired bias force.

Of two and a half counterclockwise rotations of the carriage driving gear 19 resulting from the counterclockwise rotation of the stepping motor 28, the carriage transmission gear 34 rotates to its initial position during the first two rotations. During the next half rotation, the carriage transmission gear 34 stands still, because the cogless part 34*b* of the first transmission gear 34A of the carriage transmission gear 34 is positioned opposite to the cogless part 19*b* of the partially cogged gear 19B of the carriage driving gear 19.

In other words, the carriage transmission gear 34 is arranged so as to rotate one-third turn during the first half rotation of the carriage driving gear 19, so that the cogless part 34*b* of the first transmission gear 34A is positioned opposite to the cogless 19*b* of the partially cogged gear 19B of the carriage driving gear 19. During the next half rotation of the carriage driving gear 19, the carriage transmission gear 34 stands still. During two and a half counterclockwise rotations of the carriage drive gear 19 from this position, the carriage transmission gear 34 stays still during the first half rotation. Then, the carriage transmission gear 34 rotates one-third turn during the second half rotation of the carriage drive gear 19. It again stays still during the third half rotation, and it again rotates one-third turn during the fourth half rotation.

During these subsequent two and a half counterclockwise rotations of the carriage driving gear 19, the roller driving gear 24 stays still, because the cogless part 34*d* of the second transmission gear 34B of the transmission gear 34 is opposite to the cogless part 24*b* of the roller driving gear 24.

As with the previously mentioned first half counterclockwise rotation of the carriage driving gear 19, the cogged part 19*b* of the cogless gear 19B of the carriage driving gear 19 engages with the cogged part 34*a* of the first transmission gear 34A of the transmission gear 34, as a result of the final half counterclockwise rotation of the carriage driving gear 19 caused by the counterclockwise rotation of the stepping motor 28. Then, the transmission gear 34 rotates clockwise one-third turn, as shown in FIG. 8. At this time, the cogged part 34*c* of the second transmission gear 34B of the transmission gear 34 engages with the cogged part 24*a* of the roller driving gear 24, thereby causing the roller driving gear 24 to rotate counterclockwise one-half turn, as shown in FIG. 9. As previously mentioned, the roller driving gear 24 is connected to the roller drive shaft 22 via the one-way clutch 36, and therefore the counterclockwise rotation of the roller driving gear 24 as designated by the arrow A shown in FIG. 8 will not be transmitted to the roller drive shaft 22. For this reason, the roller driving gear 24 simply idles.

During the final half counterclockwise rotation of the carriage driving gear 19 resulting from the counterclockwise rotation of the stepping motor 28, the carriage 14 travels along the tapered portion 12*b* of the cam 13*b* formed at the right end of the platen attachment section 8 toward the end edge 11*b* of the cam 13 shown in FIG. 1. Together with the movement of the carriage 14, the thermal head 10 is gradually caused to move away from the platen 7 and is finally brought into a head-up position. Consequently, the carriage 14 completes its rightward movement as designated by the arrow D in FIG. 1.

As described above, while the carriage 14 travels along the tapered portion 12*b* of the cam 13*b* until it reaches the end edge 11*b*, the leaf spring travels downward along the tapered section 46 of the leaf spring abutment section 45 from the position shown in FIG. 4 to the position shown in FIG. 5. Although the load that the carriage 14 receives from the cam 13*b* increases while the carriage 14 travels along the tapered portion 12*a* of the cam 13*b*, the biasing force of the leaf spring is reduced correspondingly. Accordingly, the carriage 14 can easily travel along the tapered portion 12*b* of the cam 13*b* with smaller torque. In other words, a low-power motor can be used as a stepping motor for driving the carriage 14 without problems.

When the carriage 14 is positioned at the rightmost end of the movable range opposite to the home position, the partially cogged gear 19B of the carriage driving gear 19 is positioned such that the cogged gear 19*b* thereof is directed to the upper left, as is shown in FIG. 11. The cogless part 34*a* of the first transmission gear 34A of the carriage transmission gear 34 is positioned adjoining to the cogged part 19*a* of the partially cogged gear 19B so as to be opposite to the cogless part 19*b*. As a result, the carriage driving gear 19 does not engage with the carriage transmission gear 34.

At this time, the second transmission gear 34B of the carriage transmission gear 34 is positioned such that the cogless part 34*c* is directed to the lower left, as is shown in FIG. 11. The cogless part 24*b* of the roller driving gear 24 is positioned adjoining to the cogged part 34C of the second transmission gear 34B so as to be opposite to the cogless part 34*d*. Eventually, the carriage transmission gear 34 does not engage with the roller driving gear 24.

As has been described, the movement of the carriage 14 in the direction designated by the arrow D in FIG. 1 is now completed, and thus the printing of one line onto the heat sensitive paper sheet 4 carried out by the thermal head 10 is also completed.

On the assumption that the stepping motor 28 is driven by a control command from the controller 35 and the output shaft 28 of the stepping motor 29 starts to rotate clockwise as being shown in FIG. 9 while the carriage 14 is positioned at the rightmost end in the movable range opposite to the home position, the carriage output gear 29 attached to the leading end of the output shaft 28*a* also starts to rotate clockwise. As a result, the rotating force (torque) of the stepping motor 28 is transmitted to the carriage driving gear 19 via the idle gear 33. Eventually, the carriage driving gear 19 starts to rotate clockwise, as it is shown in FIG. 9. Associated with the clockwise rotation of the carriage driving gear 19, the carriage drive shaft 18 also starts to rotate clockwise, and the worm 17 connected to the carriage drive shaft 18 by the spline also rotates clockwise. It also starts to travel over the rack plate 20 in the leftward direction as designated by the arrow E shown in FIG. 1. As the worm 17 travels leftward, the carriage 14 also starts to travel leftward as designated by the arrow E shown in FIG. 1.

During the first half clockwise rotation of the carriage driving gear 19 resulting from the clockwise rotation of the stepping motor 28, the cogged part 19*a* of the partially cogged gear 19B of the carriage driving gear 19 comes to mesh with the cogged part 34*a* of the first transmission gear 34A of the transmission gear 34. The carriage transmission gear 34 then rotates counterclockwise one-third turn, as shown in FIG. 10. At this time, the cogged part 34*c* of the second transmission gear 34B of the carriage transmission gear 34 meshes with the cogged part 24*a* of the roller driving gear 24. The roller driving gear 24 then rotates clockwise by a predetermined amount (until it reaches the cogless part 24*b* at the opposite position), as shown in FIG. 9. The clockwise rotation of the roller driving gear 24 in the direction designated by the arrow A shown in FIG. 8 is transmitted to the roller drive shaft 22 which is connected to the roller driving gear 24 via the one-way clutch 36. Consequently, the roller drive shaft 22 rotates clockwise one-half turn. As the roller drive shaft 22 rotates clockwise, the paper feed roller 23 rotates clockwise. As a result of the clockwise rotation of the paper feed roller 23, the heat sensitive paper sheet 4 is fed (conveyed) in such a direction as designated by the arrow C shown in FIG. 2, whereby line feed is implemented by a predetermined amount necessary to print the next line.

During further two and a half clockwise rotations of the carriage gear 19 resulting from the clockwise rotation of the stepping motor 28, the carriage 14 travels further to the left while retaining the thermal head 10 in the head-down state, that is, while it is pressed against the platen 7. The plurality of heating elements (not shown) regularly arranged on the thermal head 10 are selectively heated according to predetermined printing information so as to print the next line onto the heat sensitive paper 4.

During the two and a half clockwise rotations of the carriage driving gear 19, the carriage transmission gear 34 repeats a stopping action and a one-third rotation for every half rotation of the carriage driving gear 19, beginning with the stopping action; namely, stop, a one-third rotation, stop, a one-third rotation, and stop, until it returns to the condition shown in FIG. 1.

Further, during these two and a half clockwise rotations of the carriage driving gear 19, the roller driving gear 24 stands still, because the cogless part 34*d* of the second transmission gear 34B of the carriage transmission gear 34 is positioned opposite to the cogless part 24*b* of the roller driving gear 24.

Similarly to the case of the rightward movement of the carriage 14 described above, the leaf spring urges the carriage 14 toward the platen 7 while having one end abutting on the top surface of the leaf spring abutment section 45, as is shown in FIG. 4.

During the final half clockwise rotation of the carriage driving gear 19 resulting from the clockwise rotation of the stepping motor 28, the carriage 14 travels along the tapered portion 12*a* of the cam 13 formed at the left end of the platen attachment section 8 toward the end edge 11*a*. As the carriage 14 travels, the thermal head 10 is gradually lifted away from the platen 7. It is finally brought into the head-up state, and the carriage 14 now completes traveling leftwards in the direction designated by the arrow E shown in FIG. 1. Concurrently, the heat sensitive paper 4 is fed (conveyed). Similarly to the first half clockwise rotation of the carriage drive gear 19, the roller driving gear 24 and the roller drive shaft are rotated clockwise via the carriage transmission gear 34. The heat sensitive paper 4 is then fed (conveyed) by an amount necessary for the next printing operation.

The leaf spring travels downward along the tapered section 46 of the leaf spring abutment section 45 in such a direction as to reduce the increasing biasing force of the leaf spring, from the position shown in FIG. 4 to that in FIG. 5. Consequently, the biasing force urging the carriage 14 toward the platen is also reduced.

As described above, the carriage 14 travels leftward as designated by the arrow E shown in FIG. 1, so that the thermal head 10 prints one line onto the heat sensitive paper 4. Thus, the feed line of the heat sensitive paper 4 is now completed.

According to the embodiment of the thermal printer 1 of the present invention, the thermal head 10 is directly attached to the carriage without any intervening member, and the carriage 14 itself can be rotated toward the platen 7 by the biasing force of the leaf spring. With this arrangement, it becomes unnecessary to separately provide the conventional head mounting unit 44, which contributes to the reduction in the number of parts and thus associated costs.

The plate sprint abutment section 45 is provided with the tapered sections 46 opposite to the cams 13*a* and 13*b*, and these tapered sections are tapered in such a direction as to reduce the increasing biasing force of the leaf spring as the carriage approaches the respective ends of the cams. This makes it possible to reduce an increase in the biasing force of the leaf spring, which in turn reduces the load acting on the carriage 14. As a result, even a low-power inexpensive driving motor can reliably drive the carriage 14.

By means of the torque transmission means 37 described in the first embodiment of the thermal printer 1 of the present invention, it is possible for the single stepping motor 28 to drive the carriage 14 and the paper feed roller 23. Further, it is possible to easily control the movement of the carriage 14 and the rotations of the paper feed roller 23 by correlating them with each other. As a result, the thermal printer can be reduced in size and cost.

In the present embodiment, the torque is transmitted from the stepping motor 28 to the paper feed roller 23 while the thermal head 10 is lifted from the platen 7 by means of the cams 13*a* and 13*b*, i.e., while it is in the head-up state. Thus, it is possible to ensure the prevention of interference between the movement of the thermal head 10 associated with the movement of the carriage 14 and the feeding of the heat sensitive paper 4 carried out by the paper feed roller 23 (i.e., it is possible to ensure the prevention of the feeding of the heat sensitive paper 4 during the movement of the thermal head 10).

The present invention is not limited to the above embodiment but can be modified as required.

For instance, in the above embodiment, the carriage 14 is moved from one end to the other by rotating the carriage driving gear 19 three and a half rotations. The carriage 14 travels during the middle two and a half rotations of the three and a half rotations of the carriage drive gear 19. As a result, the remaining one rotation comprising the first half clockwise rotation and the last half clockwise rotation that take place when the carriage 14 is positioned at the respective ends of the movable range are used for feeding (conveying) the heat sensitive paper 4. However, the number of rotations of the carriage driving gear 19 may be optionally selected by modifying the shapes of the gears 19, 24, and 34, all constituting the torque transmission means 37. In this case, the number of rotations of the carriage driving gear 19 for moving the carriage 14 from one end to the other may be set as N/M rotations, while the number of rotations for feeding the heat sensitive paper carried out by the paper feed roller 23 may be set as m/M rotations (wherein $N=M\times n+m$, $m<M$, and M, N, and n are integers).

The torque transmission means 37 is constituted such that the carriage drive shaft 18 and the roller drive shaft 22 are both driven by the single stepping motor 28 via the plurality of gears. However, the carriage drive shaft 18 and the roller drive shaft 22 may be provided with specially designed drive motors, respectively, so that they are driven by a different driving motor.

As described above, according to the thermal printer of the present invention, it is possible to reduce the number of parts for mounting a thermal head onto a carriage and thus the associated costs, as well as to reliably drive the carriage using a low-power drive motor without problems.

What is claimed is:

1. A thermal printer comprising:

an external frame;

a platen fixedly mounted on the external frame;

a carriage movably mounted on the external frame such that the carriage is restricted to reciprocate parallel to the platen, the carriage having a first surface facing the platen and a second surface facing away from the platen;

a thermal head attached to the carriage on the first surface;

a biasing member for urging the carriage toward the platen; and an elongated abutment section mounted on the external frame and aligned parallel to the platen;

wherein the biasing member includes a leaf spring having a first end fixedly attached to the second surface of the carriage and a second end abutting the abutment section such that the second end of the leaf spring slides against the abutment section as the carriage reciprocates along the platen.

2. The thermal printer as in claim 1, further comprising:

two cams disposed in the vicinity of both ends of the platen outside a printable range of the thermal head for urging the thermal head away from the platen against a biasing force of the leaf spring when the thermal head travels beyond the printable range as the carriage moves relative to the platen, and wherein the abutment section includes tapered sections formed at ends thereof such that one end of the leaf spring abuts the tapered sections when the carriage travels along the cams, and which are tapered in such a direction so as to reduce the biasing force applied by the leaf spring to the carriage as the carriage approaches the respective ends of the cams.

* * * * *